US007264528B2

(12) United States Patent
Hasegawa et al.

(10) Patent No.: US 7,264,528 B2
(45) Date of Patent: Sep. 4, 2007

(54) SUBSTRATE ASSEMBLY FOR GAS DISCHARGE PANEL, PROCESS FOR MANUFACTURING THE SAME, AND GAS DISCHARGE PANEL

(75) Inventors: Minoru Hasegawa, Kawasaki (JP); Osamu Toyoda, Kawasaki (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 11/482,931

(22) Filed: Jul. 10, 2006

(65) Prior Publication Data

US 2006/0252338 A1 Nov. 9, 2006

Related U.S. Application Data

(62) Division of application No. 10/617,227, filed on Jul. 11, 2003.

(30) Foreign Application Priority Data

Jul. 23, 2002 (JP) ..... 2002-214176

(51) Int. Cl.
*H01J 9/00* (2006.01)

(52) U.S. Cl. ..... 445/24; 427/68

(58) Field of Classification Search ..... 445/24; 427/68

See application file for complete search history.

(56) References Cited

U.S. PATENT DOCUMENTS

| | | | | |
|---|---|---|---|---|
| 6,160,345 | A | 12/2000 | Tanaka et al. | 313/489 |
| 6,428,913 | B1 * | 8/2002 | Yoshihara et al. | 428/702 |
| 6,605,834 | B1 | 8/2003 | Lee | 257/295 |
| 6,650,063 | B2 | 11/2003 | Uemura et al. | 315/169.4 |
| 6,700,324 | B2 | 3/2004 | Bechtel et al. | 313/587 |
| 2001/0005115 | A1 | 6/2001 | Busio et al. | |
| 2003/0038599 | A1 | 2/2003 | Aoki et al. | 313/587 |
| 2004/0075388 | A1 | 4/2004 | Miyashita et al. | 313/586 |

FOREIGN PATENT DOCUMENTS

| | | |
|---|---|---|
| JP | 6-162920 | 6/1994 |
| JP | 6-234917 | 8/1994 |
| JP | 9-12940 | 1/1997 |
| JP | 9-12976 | 1/1997 |
| JP | 10-340676 | 12/1998 |
| TW | 469476 | 12/2001 |
| TW | 478007 | 3/2002 |
| WO | WO 02/31853 | 4/2002 |

* cited by examiner

*Primary Examiner*—Vip Patel
(74) *Attorney, Agent, or Firm*—Staas & Halsey LLP

(57) ABSTRACT

A substrate assembly for a gas discharge panel, comprising a dielectric layer and a protective layer of MgO being formed in this order on a substrate having electrodes, wherein the dielectric layer is a laminate of an organic dielectric layer and an inorganic dielectric layer in this order from a side of the substrate.

7 Claims, 4 Drawing Sheets

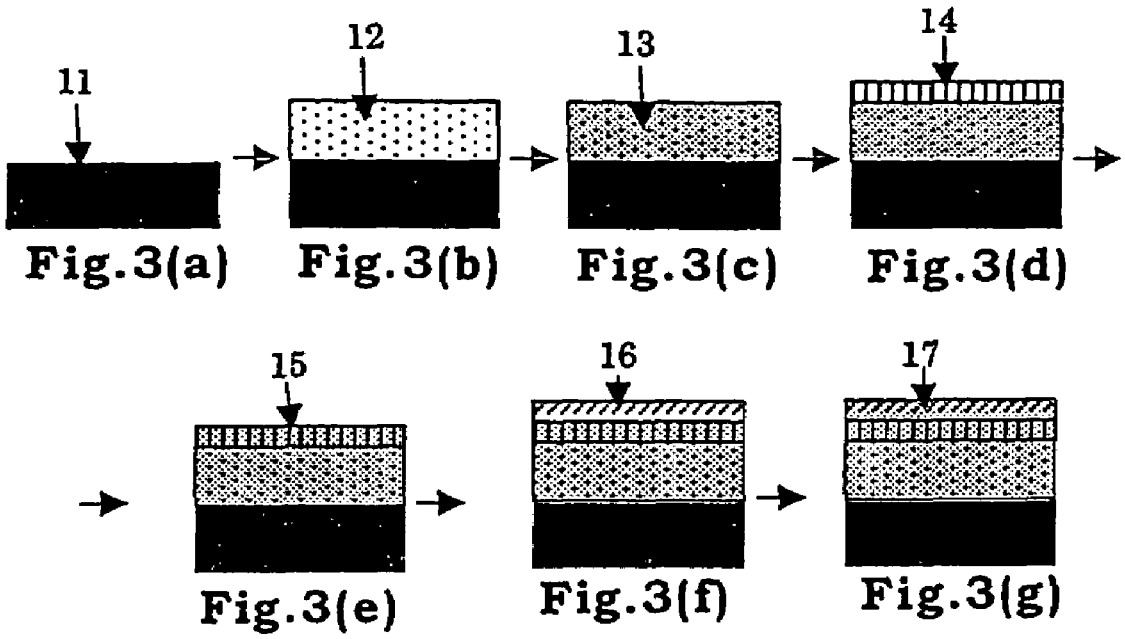
Fig.3(a) Fig.3(b) Fig.3(c) Fig.3(d)
Fig.3(e) Fig.3(f) Fig.3(g)
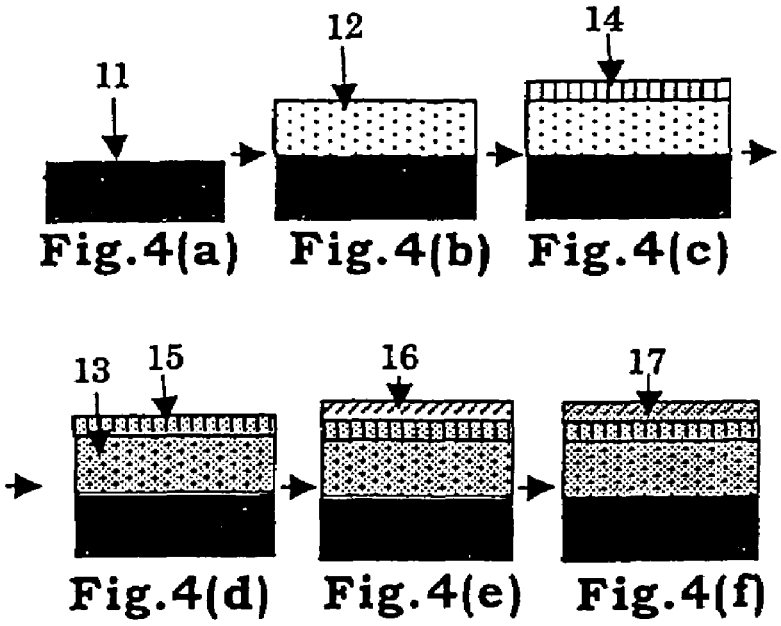
Fig.4(a) Fig.4(b) Fig.4(c)
Fig.4(d) Fig.4(e) Fig.4(f)

SUBSTRATE ASSEMBLY FOR GAS DISCHARGE PANEL, PROCESS FOR MANUFACTURING THE SAME, AND GAS DISCHARGE PANEL

This application is a divisional of application Ser. No. 10/617,227, filed Jul. 11, 2003.

CROSS-REFERENCE TO RELATED APPLICATION

This application is related to Japanese application No. 2002-214176 filed on Jul. 23, 2002, whose priority is claimed under 35 USC § 119, the disclosure of which is incorporated by reference in its entirety.

BACKGROUND OF THE INVENTION

1. Field of the Invention

The present invention relates to a substrate assembly for a gas discharge panel, a process for manufacturing the substrate assembly, and a gas discharge panel using the substrate assembly.

2. Description of Related Art

Various types of panels have been reported to be used as gas discharge panels. Among these panels, AC-type plasma display panels (PDPs) of a three-electrode surface discharge structure have been commercialized. PDPs have been drawing attention as low-profile display devices having a wide visual angle, and the development of PDPs to high definition and large screen has been pursued to expand their use in the field of High-Vision.

FIG. 1 is a schematic perspective view of the structure of a commercialized PDP. The PDP has a front substrate assembly and a rear substrate assembly bonded together. The front substrate is so constructed that display electrodes each constituted of a transparent electrode 3 and a bus electrode 4 are arranged on a glass substrate 1 serving as a base of the front substrate assembly and are covered with a dielectric layer 5, on which is formed a protective layer 9 of MgO having a high secondary electron emission yield. The rear substrate assembly is so constructed that address electrodes 6 are arranged on a glass substrate 2 serving as a base of the rear substrate assembly so as to cross the display electrodes, barrier ribs 7 for partitioning a discharge space are provided between the address electrodes 6, phosphors 8 of red, green and blue colors are applied onto an area which is divided by the barrier ribs 7 and which covers the address electrodes 6. A Ne—Xe gas is enclosed within the discharge space formed between the front and rear substrate assemblies that are bonded together.

The dielectric layer is made mainly of a glass material and is formed by screen-printing a glass paste or laminating sheet glass. Other than the glass material, it has been proposed to use a polymer having a lower dielectric constant than that of the glass material (for example, Japanese Unexamined Patent Publication No. Hei 6(1994)-234917). Use of polymers having a lower dielectric constant can reduce a driving voltage of a gas discharge panel.

The MgO protective layer 9 is formed on the dielectric layer mainly by a vapor deposition process or a process of sputtering Mg in an atmosphere of $O_2$. Other than these processes, there has been proposed a wet process comprising forming a film of a paste of an organic compound containing Mg such as a carboxylate of Mg by screen printing or the like and firing the film so as to remove an organic component therefrom for forming a MgO layer (for example, Japanese Unexamined Patent Publication No. Hei 9(1997)-12976). In wet processes compared with dry processes such as the vapor deposition process and the sputtering process, the manufacturing costs can be reduced because the manufacturing apparatus are not expensive and the manufacturing conditions are easily adjusted.

However, it has been difficult to simply combine a dielectric layer of a polymer having a low dielectric constant and a protective layer of an organic compound containing Mg. When they are simply combined, a problem occurs that the dielectric layer is liable to be peeled off because:

(1) the dielectric layer of a polymer deteriorates by a solvent used for making a paste of the Mg-containing organic compound, and (2) the dielectric layer of a polymer having a great surface friction is destroyed by the solvent or by a stress generated, in the protective layer, when an organic component of the organic compound is eliminated by firing.

SUMMARY OF THE INVENTION

The present invention provides a substrate assembly for a gas discharge panel, comprising a dielectric layer and a protective layer of MgO being formed in this order on a substrate having electrodes, wherein the dielectric layer is a laminate of an organic dielectric layer and an inorganic dielectric layer in this order from a side of the substrate.

The present invention also provides a process for manufacturing a substrate assembly for a gas discharge panel, comprising:

forming an organic dielectric layer on a substrate;

forming an inorganic dielectric layer on the organic dielectric layer by a sol-gel, a sputtering or a vapor deposition process;

forming an organic compound layer containing Mg on the inorganic dielectric layer; and firing the organic compound layer to form a protective layer of MgO.

The present invention further provides a gas discharge panel, comprising:

a substrate assembly as above disclosed disposed on a front side of the panel as a front substrate assembly;

a rear substrate assembly facing the front substrate assembly; and a discharge space formed between the front and rear substrate assemblies, wherein the rear substrate assembly is provided with barrier ribs for defining the discharge space and phosphors, the barrier ribs being formed on a substrate having electrodes, the phosphors being formed on side walls of the barrier ribs and on the substrate defined by the barrier ribs.

These and other objects of the present application will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

FIG. 3(*a*)-(*g*) are schematic cross sectional views for explaining a process for manufacturing the gas discharge panel (PDP) of the present invention;

FIGS. 4(*a*)-(*f*) are schematic cross sectional views for explaining the process for manufacturing the gas discharge panel (PDP) of the present invention;

DESCRIPTION OF THE PREFERRED EMBODIMENTS

Figure 1:
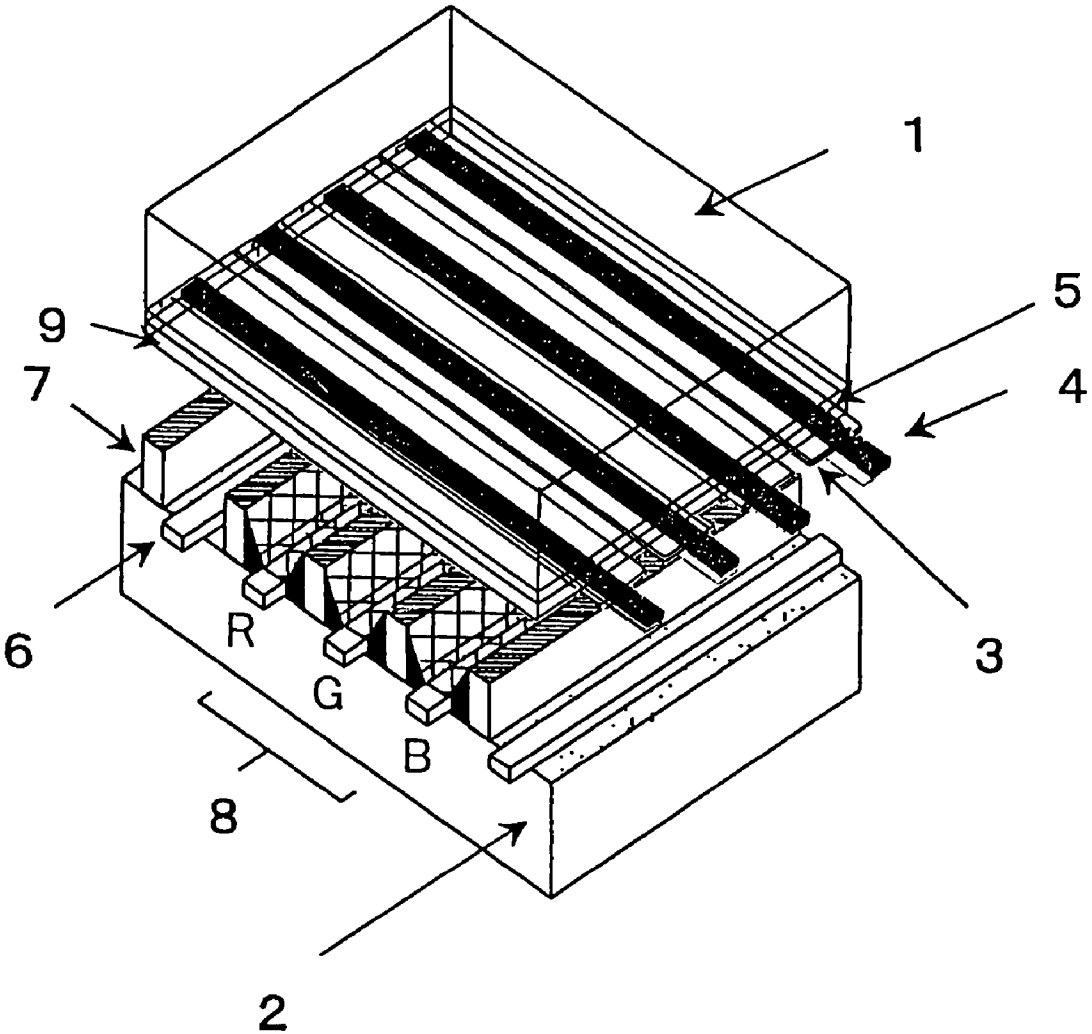
Fig.1 prior art
FIG. 1 is a schematic perspective view of a conventional gas discharge panel (PDP)

A substrate assembly for a gas discharge panel of the present invention disposed on, for example, a front side of the panel comprises an organic dielectric layer, an inorganic dielectric layer and a protective layer of MgO in this order from a substrate side. The present invention solves the aforementioned problem by interposing the inorganic dielectric layer between the organic dielectric layer and the protective layer so as not to bring the organic dielectric layer into direct contact with the protective layer. In other words, the present invention makes it possible that the inorganic dielectric layer diffuses the stress generated at the time of forming the protective layer and thereby prevents the organic dielectric layer from being adversely affected by the stress.

An organic material comprised in the organic dielectric layer may be any known material for dielectric layers, though it is preferable that the organic material is a material resistant to a temperature during thermal treatment of the inorganic dielectric layer detailed later and the protective layer, and it is more preferable that the organic material is a material that allows the organic dielectric layer to have a dielectric constant lower than those of conventional dielectric layers of a low-melting glass. Conventional dielectric layers of a low-melting glass have dielectric constants in the range of 9-13, and it is preferable that the organic material is a material that allows the organic dielectric layer to have a dielectric constant lower than those of conventional dielectric layers by 2 or more. Also, it is preferable that the organic dielectric layer has a dielectric constant of approx. 2-9. The dielectric constant is measured by an LCR-meter (measurement frequency: 100 kHz).

Further, it is preferable that the organic dielectric layer has a dielectric constant lower than that of the inorganic dielectric layer detailed later.

Specifically, the organic material may be polyimide, polyamide imide, polysiloxane or polysilazane. Further, polysiloxane and polysilazane may have a side chain selected from an alkyl group (for example, methyl, ethyl and propyl groups, and the like), an alkoxy group (for example, methoxy, ethoxy and propoxy groups, and the like), and an aryl group (for example, phenyl and naphthyl groups, and the like, optionally substituted by a methyl, an ethyl, a methoxy or an ethoxy group, or a fluorine, a chlorine or a bromine atom, or the like).

It is preferable that the thickness of the organic dielectric layer is 5-20 μm though it depends on the specific organic materials.

A process for forming the organic dielectric layer is not particularly limited and may be any know process. For example, the organic dielectric layer can be formed by dissolving or dispersing the organic material in a solvent such as xylene, propylene glycol monomethyl ether acetate or the like to make a paste, applying the paste onto a substrate by, for example, screen printing, and curing the resultant coating film by heating. If necessary, the coating film may be dried before curing so as to remove a remaining solvent therefrom.

It is preferable that the inorganic material comprised in the inorganic dielectric layer has no reactivity with both the organic material for the organic dielectric layer and a material for the protective layer detailed later, and has a high stress-resistance. Specifically, the inorganic material may be $SiO_2$, $Al_2O_3$, $TiO_2$, $ZrO_2$, AlN, $Si_3N_4$ or SiC, or a mixture thereof. The organic dielectric layer may possibly cause degradation in discharge characteristics of the gas discharge panel by being irradiated with vacuum ultra violet rays generated during electric discharge in the gas discharge panel to decompose the organic material of the organic dielectric layer and discharge it into the discharge space. To prevent the organic material from being decomposed, it is preferable to employ an inorganic dielectric layer of a metal oxide having a smaller bond distance between an oxygen atom and a metal atom than the wavelength of an atom vacuum ultra violet ray.

It is preferable that the thickness of the inorganic dielectric layer is 0.5-2 μm though it depends on the specific materials of the inorganic dielectric layer. Also, it is preferable that the dielectric constant of the inorganic dielectric layer is 3-10.

A process for forming the inorganic dielectric layer is not particularly limited and may be any know process. For example, wet processes such as a sol-gel process and dry processes such as the sputtering process and the vapor deposition process may be mentioned.

For the sol-gel process, the inorganic dielectric layer can be formed by applying a paste of an alkoxide or a fatty acid salt of Si, Al, Ti, Zr or the like, or cyclic polysilazane and of a solvent to make a coating film and firing it in an atmosphere of oxygen or nitrogen at, for example, 400-800° C.

For the sputtering process, the inorganic dielectric layer can be formed by sputtering a target of Si, Al, Ti, Zr, SiC or the like in an atmosphere of oxygen or nitrogen or an inert atmosphere. For the vapor deposition process, the inorganic dielectric layer can be formed by evaporating the material comprised in the inorganic dielectric layer in vacuo if necessary to deposit it upon the organic dielectric layer.

A process for forming the MgO protective layer is not particularly limited. However, forming the MgO protective layer by forming and firing an organic compound layer containing Mg eliminates the need of using a vacuum apparatus and thereby provides advantages that a coating film can be easily formed and that constructions such as porous body can be selected. According to the present invention, the inorganic dielectric layer is provided between the organic dielectric layer and the protective layer, so that the stress generated in the protective layer by firing can be prevented from adversely affecting the organic dielectric layer.

It is preferable that the thickness of the protective layer is 0.5-1.5 μm.

The organic compound layer containing Mg is not particularly limited if firing it forms the MgO protective layer. For example, the Mg-containing organic compound layer may be a layer of an alkoxide or a fatty acid salt of Mg, or the like. More specifically, it may be a layer of a monoester dibasic acid salt represented by the formula:

$Mg(OCOR^1COOR^2)_2$, wherein $R^1$ is an alkylene or an alkylidene group and $R^2$ is an alkyl group as described in Japanese Unexamined Patent Publication No. Hei 9(1997)-12976; a layer of an alkoxide represented by the formula: $Mg(OR)_2$, wherein R is, the same or different, a univalent hydrocarbon or a univalent acyl group optionally substituted by a hydroxyl group, and, in the case of the acyl group, two Rs may be linked together to form a divalent acyl group as described in Japanese Unexamined Patent Publication No. Hei 6(1994)-162920; or a layer of an aliphatic monocarboxylic acid salt having 1-10 carbon atoms as described in Japanese Unexamined Patent Publication No. Hei 9(1997)-12940.

A process for forming the organic compound layer is not particularly limited and may be any known process. For example, one of the above-mentioned organic materials are dissolved or dispersed in a solvent such as ethanol, propylene glycol monomethyl ether acetate or the like to make a paste, the paste is applied onto the substrate by, for example, screen printing, and the resultant coating layer is cured by firing for forming the protective layer. If necessary, the coating layer may be dried before curing so as to remove a remaining solvent therefrom.

When the organic dielectric layer, the inorganic dielectric layer and the protective layer are formed by heating (firing), the organic dielectric layer and the inorganic dielectric layer may be heated simultaneously or the organic dielectric layer, the inorganic dielectric layer and the protective layer may be heated simultaneously. Simultaneous heating makes it possible to reduce the number of operations. However, for carrying out simultaneous heating, it is preferable to lower a heating temperature so that the materials for those layers are not mixed with each other or dry the materials before heating so as to remove the solvents contained therein.

The structure of the gas discharge panel of the present invention is not particularly limited if the panel comprises the organic dielectric layer, the inorganic dielectric layer and the protective layer, and other elements are properly selected in accordance with a desired structure of the panel. A substrate as a base of the substrate assembly is not particularly limited and may be any known substrate in the art Specifically, the substrate may be a transparent substrate such as a glass substrate, a plastic substrate or the like. Electrodes formed on the substrate may be metal electrodes of Al, Cu, Cr or the like; electrodes with a three layered structure such as Cr/Cu/Cr or the like; or transparent electrodes of, for example, ITO, NESA or the like.

The present invention further provides a gas discharge panel, comprising: a substrate assembly as above disclosed disposed on a front side of the panel as a front substrate assembly; a rear substrate assembly facing the front substrate assembly; and a discharge space formed between the front and rear substrate assemblies, wherein the rear substrate assembly is provided with barrier ribs for defining the discharge space and phosphors, the barrier ribs being formed on a substrate having electrodes, the phosphors being formed on side walls of the barrier ribs and on the substrate defined by the barrier ribs.

The substrate, electrodes, barrier ribs and phosphor comprised in the rear substrate assembly are not particularly limited and may be properly selected in accordance with the types of gas discharge panel.

Specifically, the gas discharge panel of the present invention may be a PDP, plasma address liquid crystal panel (PALC) or the like, among which, the PDP is preferable. Hereafter, an explanation will be made on the structure of the PDP with reference to FIG. 2.

Figure 2:
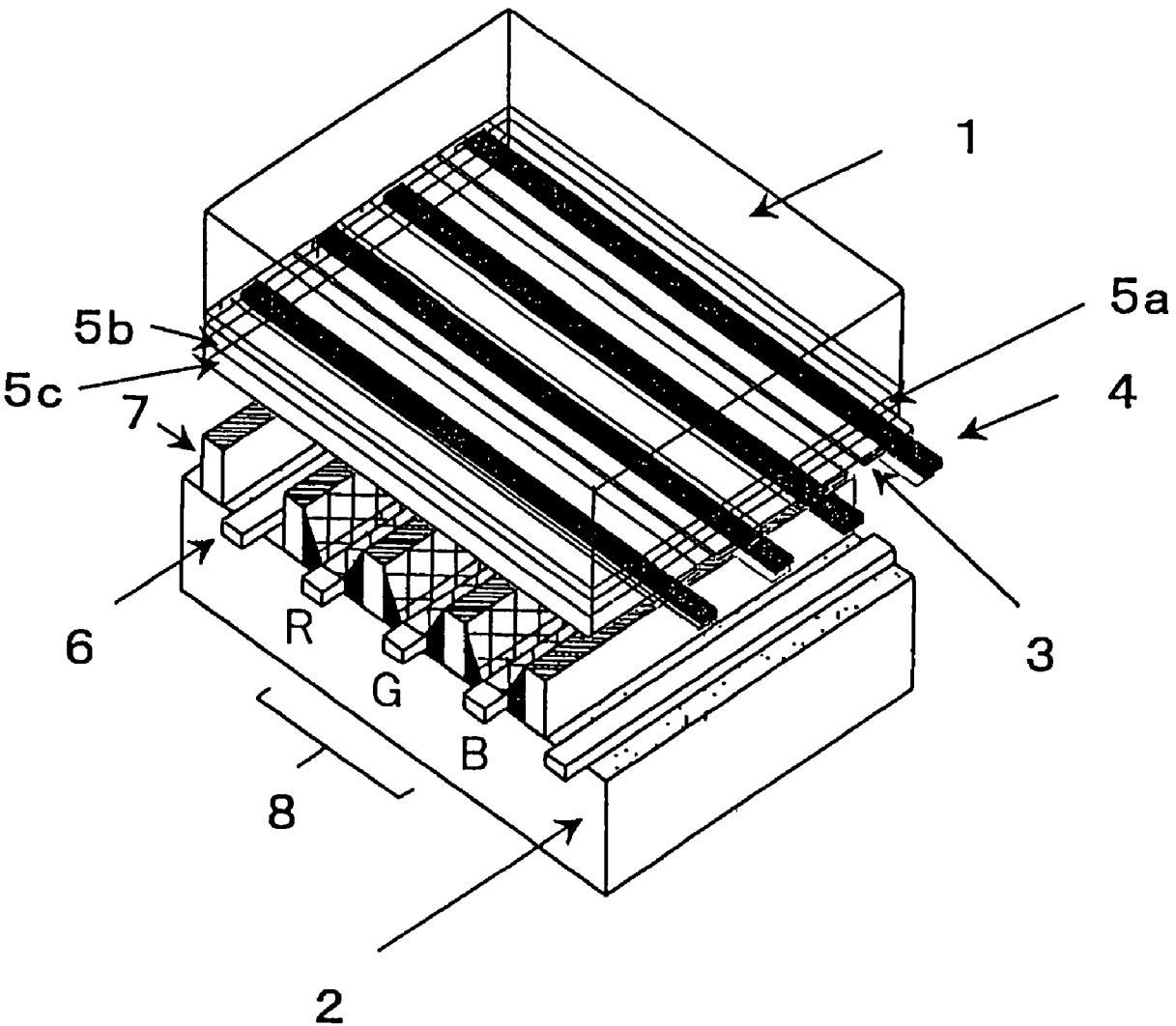
FIG. 2 is a schematic perspective view of a gas discharge panel (PDP) of the present invention.

A PDP shown in FIG. 2 is an AC-type PDP of a three-electrode surface discharge structure. In this PDP, subpixels are defined by stripe barrier ribs. The present invention, however, is applicable not only to this type of PDP but also to any type of PDP. For example, the present invention is applicable to PDPs of a two-electrode opposite discharge structure and transmissive type PDPs in which a substrate assembly having a phosphor is disposed on a front side of the PDP.

The PDP of FIG. 2 includes front and rear substrate assemblies.

The front substrate assembly comprises a plurality of stripe display electrodes formed on a glass substrate 1, an organic dielectric layer 5*a* covering the display electrodes, an inorganic dielectric layer 5*b* formed on the organic dielectric layer 5*a*, and a protective layer 5*c* formed on the inorganic dielectric layer and exposed to a discharge space.

The display electrodes are each made of a transparent electrode 3 of ITO, NESA or the like and a bus electrode (of, for example, a metal layer of Al, Cr, Cu or the like or three layers of Cr/Cu/Cr) 4, as in FIG. 1, and are used to generate surface discharge for display between the display electrodes.

The rear substrate assembly comprises a plurality of stripe address electrodes (each of, for example, a metal layer of Al, Cr, Cu or the like or three layers of Cr/Cu/Cr) 6 formed on a glass substrate 2, a plurality of stripe barrier ribs 7 formed on the glass substrate 2 between the address electrodes 6, and the phosphors 8 formed between the barrier ribs on wall surfaces thereof. The phosphors 8 of FIG. 2 comprise phosphors of red (R), green (G) and blue (B) colors.

The barrier ribs 7 can be formed by applying a paste of a low-melting glass and binder onto the glass substrate 2, fired and sandblasting the resultant. When a photosensitive resin is used as the binder, the barrier ribs 7 can be formed by subjecting the binder to light exposure with a mask of a predetermined shape and development, followed by firing.

The phosphors 8 can be formed by dispersing particles of a phosphor in a solution of binder in a solvent to make a paste and applying the paste between the barrier ribs, followed by firing in an inert atmosphere.

Alternatively, the barrier ribs 7 may be formed by a known method on a dielectric layer that is formed on the glass substrate 2 so as to cover the address electrodes 6.

EMBODIMENTS

The present invention will now be explained in detail based on embodiments in which the present invention is applied to a front substrate assembly of a PDP of a three-electrode surface discharge structure. It should be understood that the present invention is not limited to the embodiments.

Embodiment 1

Polysiloxane SOG (OCDF9, manufactured by Tokyo Ohka Kogyo Co., Ltd., Japan) containing an organic component was applied by screen printing onto a glass substrate 11 having display electrodes (FIG. 3(*a*)), and the resultant substrate was dried at 150° C. for 30 minutes to form a coating film 12 (FIG. 3(*b*)). The coating film 12 was cured by heating at 500° C. for 30 minutes to form an organic dielectric layer 13 with a thickness of 10 μm (FIG. 3(*c*)).

A solution of tetraethoxysilane ($(CH_3CH_2O)_4Si$) in xylene (the concentration of tetraethoxysilane: approx. 10 wt %) was applied by screen printing onto the organic dielectric layer 13 to give a coating film 14 (FIG. 3(*d*)), and the coating film 14 was fired at 500° C. for 30 minutes to form an inorganic dielectric layer 15 with a thickness of 0.5 μm (FIG. 3(*e*)).

Next, a solution of a carboxylate of Mg (LC6-Mg, manufactured by NOF Corporation, Japan; the carboxylate: a caproic acid salt) in ethanol (the concentration of the carboxylate of Mg: approx. 10 wt %) was applied by screen printing onto the inorganic dielectric layer 15, and ethanol was removed by heating the substrate at 100° C. for 30 minutes to form a coating film 16 (FIG. 3(*f*)). The coating film 16 was fired at 500° C. for 30 minutes to form a protective layer 17 of MgO with a thickness of 0.5 μm (FIG. 3(*g*)). Thus, a front substrate assembly was completed.

Subsequently, the front substrate assembly was opposed to a rear substrate assembly separately fabricated by a known process, both substrates were sealed together to define a space therebetween, and the space was filled with discharge gas. Thus, a gas discharge panel was completed.

Embodiment 2

A solution of polysiloxane SOG (OCDF9, manufactured by Tokyo Ohka Kogyo Co., Ltd., Japan) containing an organic component in xylene (the concentration of polysilazane: approx. 10 wt %) was applied by screen printing onto the glass substrate 11 having display electrodes (FIG. 4(*a*)), and xylene was removed by heating the substrate at 150° C. for 30 minutes to form the coating film 12 for the organic dielectric layer (FIG. 4(*b*)).

A solution of tetraethyoxysilane ($(CH_3CH_2O)_4Si$) in xylene (concentration of tetraethyoxysilane: approx. 10 wt %) was applied by screen printing onto the coating film 12 to give the coating film 14 (FIG. 4(*c*)). The coating film 12 was cured and the coating film 14 was fired by heating the coating films 12 and 14 at 500° C. for 30 minutes to form the organic dielectric layer 13 with a thickness of 10 μm and the inorganic dielectric layer 15 with a thickness of 0.5 μm, simultaneously (FIG. 4(*d*)).

Next, a solution of a carboxylate of Mg (LC6-Mg, manufactured by NOF Corporation, Japan; the carboxylate: a caproic acid salt) in ethanol (the concentration of the carboxylate of Mg: approx. 10 wt %) was applied by screen printing onto the inorganic dielectric layer 15, and ethanol was removed by heating the substrate at 100° C. for 30 minutes to form the coating film 16 (FIG. 4(*e*)). The coating film 16 was fired at 500° C. for 30 minutes to form the MgO protective layer 17 with a thickness of 0.5 μm (FIG. 4(*f*)). Thus, the front substrate assembly was completed.

Subsequently, the front substrate assembly was opposed to a rear substrate assembly separately fabricated by a known process, both substrates were sealed together to define a space therebetween, and the space was filled with discharge gas. Thus, the gas discharge panel is completed.

Embodiment 3

Figures 5A, 5B, 5C:
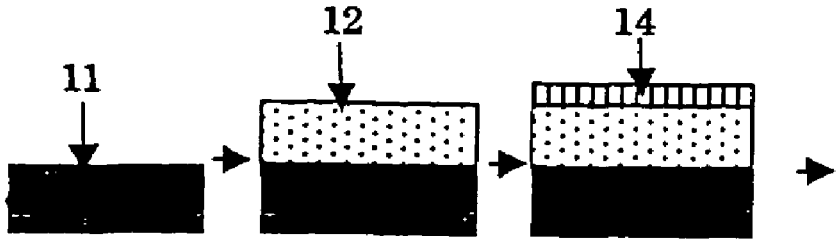
FIGS. 5(*a*)-(*e*) are schematic cross sectional views for explaining the process for manufacturing the gas discharge panel (PDP) of the present invention.
Figures 5D, 5E:
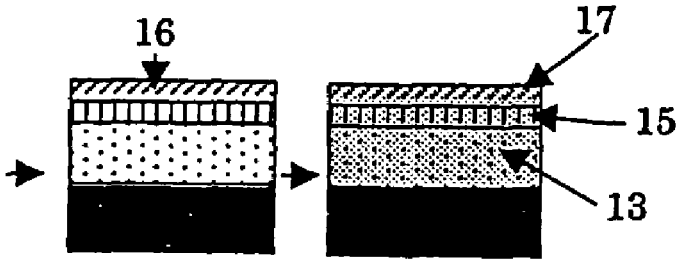

A solution of polysiloxane SOG (OCDF9, manufactured by Tokyo Ohka Kogyo Co., Ltd., Japan) containing an organic component in xylene (concentration of polysilazane: approx. 10 wt %) was applied by screen printing onto the glass substrate 11 having display electrodes (FIG. 5(*a*)), and xylene was removed by heating the substrate at 150° C. for 30 minutes to form the coating film 12 for the organic dielectric layer (FIG. 5(*b*)).

A solution of tetraethyoxysilane ($(CH_3CH_2O)_4Si$) in xylene (concentration of tetraethyoxysilane: approx. 10 wt %) was applied by screen printing onto the coating film 12 to give the coating film 14 for the inorganic dielectric layer (FIG. 5(*c*)).

Next, a solution of a carboxylate of Mg (LC6-Mg, manufactured by NOF Corporation, Japan; the carboxylate: a caproic acid salt) in ethanol (the concentration of the carboxylate of Mg: approx. 10 wt %) was applied by screen printing onto the coating film 14, and ethanol was removed by heating the substrate at 100° C. for 30 minutes to form the coating film 16 (FIG. 5(*d*)).

The coating film 12 was cured and the coating films 14 and 16 were fired by heating the coating films 12, 14 and 16 at 500° C. for 30 minutes to form the organic dielectric layer 13 with a thickness of 10 μm, the inorganic dielectric layer 15 with a thickness of 0.5 μm and the MgO protective layer with a thickness of 0.5 μm, simultaneously (FIG. 5(*e*)).

Subsequently, the front substrate assembly was opposed to a rear substrate assembly separately fabricated by a known process, both substrates were sealed together to define a space therebetween, and the space was filled with discharge gas. Thus, the gas discharge panel was completed.

Embodiment 4

Figures 6A, 6B, 6C:
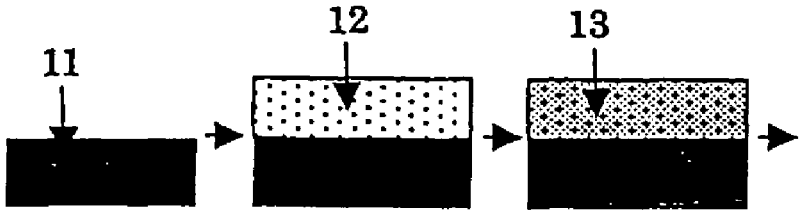
FIGS. 6(*a*)-(*f*) are schematic cross sectional views for explaining the process for manufacturing the gas discharge panel (PDP) of the present invention.
Figures 6D, 6E, 6F:
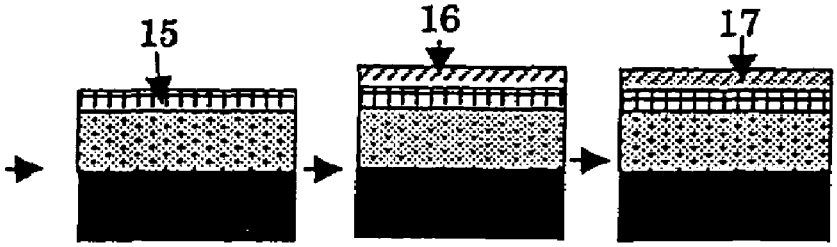

A solution of polysiloxane SOG (OCDF9, manufactured by Tokyo Ohka Kogyo Co., Ltd., Japan) containing an organic component in xylene (concentration of polysilazane: approx. 10 wt %) was applied by screen printing onto the glass substrate 11 having display electrodes (FIG. 6(*a*)), and xylene was removed by heating the substrate at 150° C. for 30 minutes to form the coating film 12 (FIG. 6(*b*)). The coating film 12 was cured by heating at 500° C. for 30 minutes to form the organic dielectric layer 13 with a thickness of 10 μm (FIG. 6(*c*)).

The inorganic dielectric layer 15 of $SiO_2$ with a thickness of 0.5 μm was formed by the sputtering process on the organic dielectric layer 13 (FIG. 16 (*d*)).

Next, a solution of a carboxylate of Mg (LC6-Mg, manufactured by NOF Corporation, Japan; the carboxylate: a caproic acid salt) in ethanol (the concentration of the carboxylate of Mg: approx. 10 wt %) was applied by screen printing onto the inorganic dielectric layer 15, and ethanol was removed by heating the substrate at 100° C. for 30 minutes to form the coating film 16 (FIG. 6(*e*)). The coating film 16 was fired at 500° C. for 30 minutes to form the MgO protective layer 17 with a thickness of 0.5 μm (FIG. 6(*f*)). Thus, the front substrate assembly was completed.

Subsequently, the front substrate assembly was opposed to a rear substrate assembly separately fabricated by a known process, both substrates were sealed together to define a space therebetween, and the space was filled with discharge gas. Thus, the gas discharge panel was completed.

The present invention makes it possible to prevent the organic dielectric layer from being peeled off from the substrate at the formation of the MgO protective layer since the inorganic dielectric layer is interposed between the organic dielectric layer and the protective layer.

Moreover, the present invention makes it possible to form the organic dielectric layer and the protective layer by the wet process, and thereby reduce the manufacturing costs since, in the wet process compared with conventional dry process, the manufacturing apparatus are not expensive and the manufacturing conditions are easily adjusted.

What is claimed is:

1. A process for manufacturing a substrate assembly for a gas discharge panel, comprising:

an organic dielectric layer formed on a substrate;

an inorganic dielectric layer formed on the organic dielectric layer; and a protective layer of MgO formed on the inorganic dielectric layer, wherein the organic dielectric layer is obtained by heating a coating film of an organic dielectric material, the inorganic dielectric layer is obtained by heating a coating film of an inorganic dielectric material formed by a sol-gel process, and the protective layer is obtained by heating a coating film of an organic compound containing Mg.

2. The process for manufacturing a substrate assembly for a gas discharge panel of claim 1, wherein the organic dielectric layer is formed by applying a paste of the organic dielectric material to form the coating film and by firing the resultant coating film, the inorganic dielectric layer is formed by applying a paste of the inorganic dielectric material on the organic dielectric layer to form the coating film and by firing the resultant coating film, and the protective layer is formed by applying a paste of the organic compound on the inorganic dielectric layer to form the coating film and by firing the resultant coating film.

3. The process for manufacturing a substrate assembly for a gas discharge panel of claim 1, wherein the organic dielectric layer and the inorganic dielectric layer are formed by applying a paste of the organic dielectric material and a paste of the inorganic dielectric material in this order to form each coating film and by firing resultant coating films, and the protective layer is formed by applying a paste of the organic compound on the inorganic dielectric layer to form the coating film and by firing the resultant coating film.

4. The process for manufacturing a substrate assembly for a gas discharge panel of claim 1, wherein the organic dielectric layer, the inorganic dielectric layer and the protective layer are formed by applying a paste of the organic dielectric material, a paste of inorganic dielectric material and a paste of the organic compound in this order to form each coating film and by firing resultant coating films.

5. The process for manufacturing a substrate assembly for a gas discharge panel of claim 1, wherein the organic dielectric layer is made of a material selected from polyimide, polyamide imide, polysiloxane and polysilazane.

6. The process for manufacturing a substrate assembly for a gas discharge panel of claim 5, wherein the organic dielectric layer is made of a material selected from polysiloxane and polysilazane each having a side chain selected from a group consisting of alkyl, alkoxy and aryl.

7. The process for manufacturing a substrate assembly for a gas discharge panel of claim 1, wherein the inorganic dielectric layer is made of a material selected from a group consisting of $SiO_2$, $Al_2O_3$, $TiO_2$, $ZrO_2$, AlN, $Si_3N_4$ and SiC, and a mixture of two or more thereof.

* * * * *